US007647983B2

(12) United States Patent
Gharsalli

(10) Patent No.: US 7,647,983 B2
(45) Date of Patent: Jan. 19, 2010

(54) MACHINE WITH AUTOMATED LINKAGE POSITIONING SYSTEM

(75) Inventor: Imed Gharsalli, Brimfield, IL (US)

(73) Assignee: Caterpillar Inc., Peoria, IL (US)

( * ) Notice: Subject to any disclaimer, the term of this patent is extended or adjusted under 35 U.S.C. 154(b) by 455 days.

(21) Appl. No.: 11/393,855

(22) Filed: Mar. 31, 2006

(65) Prior Publication Data

US 2007/0235201 A1 Oct. 11, 2007

(51) Int. Cl.
*E02F 3/00* (2006.01)

(52) U.S. Cl. ..... 172/793; 172/4.5; 172/666

(58) Field of Classification Search ..... 172/4, 172/4.5, 781, 789, 793, 743
See application file for complete search history.

(56) References Cited

U.S. PATENT DOCUMENTS

| | | | | | |
|---|---|---|---|---|---|
| 2,292,241 | A | * | 8/1942 | Reeves | 172/781 |
| 3,550,691 | A | | 12/1970 | Davies et al. | |
| 3,554,291 | A | * | 1/1971 | Rogers et al. | 172/4.5 |
| 3,739,861 | A | * | 6/1973 | Johnson et al. | 172/793 |
| 3,986,563 | A | | 10/1976 | Stubben | |
| 4,107,859 | A | | 8/1978 | Keith | |
| 4,132,290 | A | | 1/1979 | Dezelan et al. | |
| T984,004 | I4 | * | 7/1979 | Morris | 172/793 |
| 4,166,506 | A | | 9/1979 | Tezuka et al. | |
| 4,246,972 | A | * | 1/1981 | Halmosi et al. | 172/789 |
| 4,340,119 | A | * | 7/1982 | MacDonald | 172/789 |
| 4,807,131 | A | * | 2/1989 | Clegg | 701/50 |
| 4,914,593 | A | * | 4/1990 | Middleton et al. | 701/50 |
| 5,327,345 | A | * | 7/1994 | Nielsen et al. | 701/50 |
| 5,398,766 | A | | 3/1995 | Nakayama et al. | |
| 5,495,898 | A | | 3/1996 | McGugan | |
| 5,529,131 | A | | 6/1996 | Van Ornum | |
| 5,622,226 | A | * | 4/1997 | Hausman et al. | 172/4.5 |
| 5,984,018 | A | | 11/1999 | Yamamoto et al. | |
| 6,152,238 | A | * | 11/2000 | Ferrell et al. | 172/2 |
| 6,253,136 | B1 | * | 6/2001 | Stratton et al. | 701/50 |
| 6,523,617 | B2 | | 2/2003 | McGugan | |
| 6,655,465 | B2 | * | 12/2003 | Carlson et al. | 172/4.5 |

FOREIGN PATENT DOCUMENTS

| | | |
|---|---|---|
| JP | 59154235 | 9/1984 |

* cited by examiner

*Primary Examiner*—Thomas B Will
*Assistant Examiner*—Joel F Mitchell
(74) *Attorney, Agent, or Firm*—Finnegan, Henderson, Farabow, Garrett & Dunner

(57) ABSTRACT

A linkage positioning system for a machine is disclosed. The linkage positioning system has a lock pin, a linkage member having a plurality of holes configured to receive the lock pin, an actuator configured to selectively extend and retract the lock pin, and a control module in communication with the actuator. The control module is configured to receive a request for lock pin engagement with the linkage member, and retract the lock pin from a first of the plurality of holes in the linkage member. The control module is also configured to move the linkage member to align a second of the plurality of holes with the lock pin, and extend the lock pin into the second of the plurality of holes.

19 Claims, 3 Drawing Sheets

MACHINE WITH AUTOMATED LINKAGE POSITIONING SYSTEM

TECHNICAL FIELD

The present disclosure relates generally to a machine having a linkage positioning system, and more particularly to an automated linkage positioning system associated with a work tool of the machine.

BACKGROUND

Machines such as, for example, motor graders, may be used in earth leveling applications including road maintenance and surface contouring. These machines are typically equipped with a linkage member having a work implement such as a blade. The linkage member can typically be adjusted between multiple predefined positions to vary an engagement depth, a transverse engagement location, and/or an angle of the blade relative to a work surface. Manual movement of the linkage member between the predefined positions can be difficult, time consuming, and require great skill. As a result, the linkage member may not often be moved between the available positions or only moved by an experienced operator, thereby limiting functionality of the machine and increasing operational cost of the machine.

In an attempt to simplify movement of the linkage member between the different predefined locations, a hydraulically operated locking system may be provided. For example, U.S. Pat. No. 4,132,290 (the '290 patent) issued to Dezelan et al. Jan. 2, 1979, describes a locking mechanism for positioning the link bar of a motor grader. The locking mechanism includes a housing secured to a frame of the motor grader, a lock pin extendable and retractable relative to the housing for insertion into one of a plurality of spaced holes in the link bar. In response to manual movement of a remotely mounted switch, pressurized hydraulic fluid is drained from the housing causing the lock pin to retract from a hole in the link bar. When the lock pin is retracted, supporting hydraulic jacks may be manually operated to transversely shift the link bar. Once the link bar is in the desired position, hydraulic fluid may then be returned to the housing causing the lock pin to extend and engage a new one of the spaced holes, thereby locking the link bar in the new position.

While the locking mechanism of the '290 patent may simplify movement of the link bar between the different predefined locations, it may still require the skill of an experienced operator. In particular, the process of link bar positioning outlined in the '290 patent still requires manual movement of the hydraulic jacks to correctly align the lock pin with the holes in the link bar. If the lock pin and the holes are incorrectly aligned, the lock pin may not properly engage the link bar. Improper engagement could result in damage to the machine. In addition, without manual inspection, the '290 patent does not provide any indication to an operator of the machine of whether or not the link bar positioning process was successful. Further, if alignment of the lock pin and the desired hole in the link bar is not possible, the locking mechanism of the '290 patent does not provide an automated backup procedure to ensure continued operation of the machine.

The system of the present disclosure is directed to overcoming one or more of the problems set forth above.

SUMMARY OF THE INVENTION

In one aspect, the present disclosure is directed to a linkage positioning system. The linkage positioning system includes a lock pin, a linkage member having a plurality of holes configured to receive the lock pin, an actuator configured to selectively extend and retract the lock pin, and a control module in communication with the actuator. The control module is configured to receive a request for lock pin engagement with the linkage member, and retract the lock pin from a first of the plurality of holes in the linkage member. The control module is also configured to move the linkage member to align a second of the plurality of holes with the lock pin, and extend the lock pin into the second of the plurality of holes.

In another aspect, the present disclosure is directed to a method of positioning linkage of a machine. The method includes receiving a request for engagement of a lock pin with a linkage member, and automatically retracting the lock pin from a first of a plurality of holes in the linkage member. The method also includes automatically moving the linkage member to align a second of the plurality of holes with the lock pin, and automatically extending the lock pin into the second of the plurality of holes.

DETAILED DESCRIPTION

Figure 1:
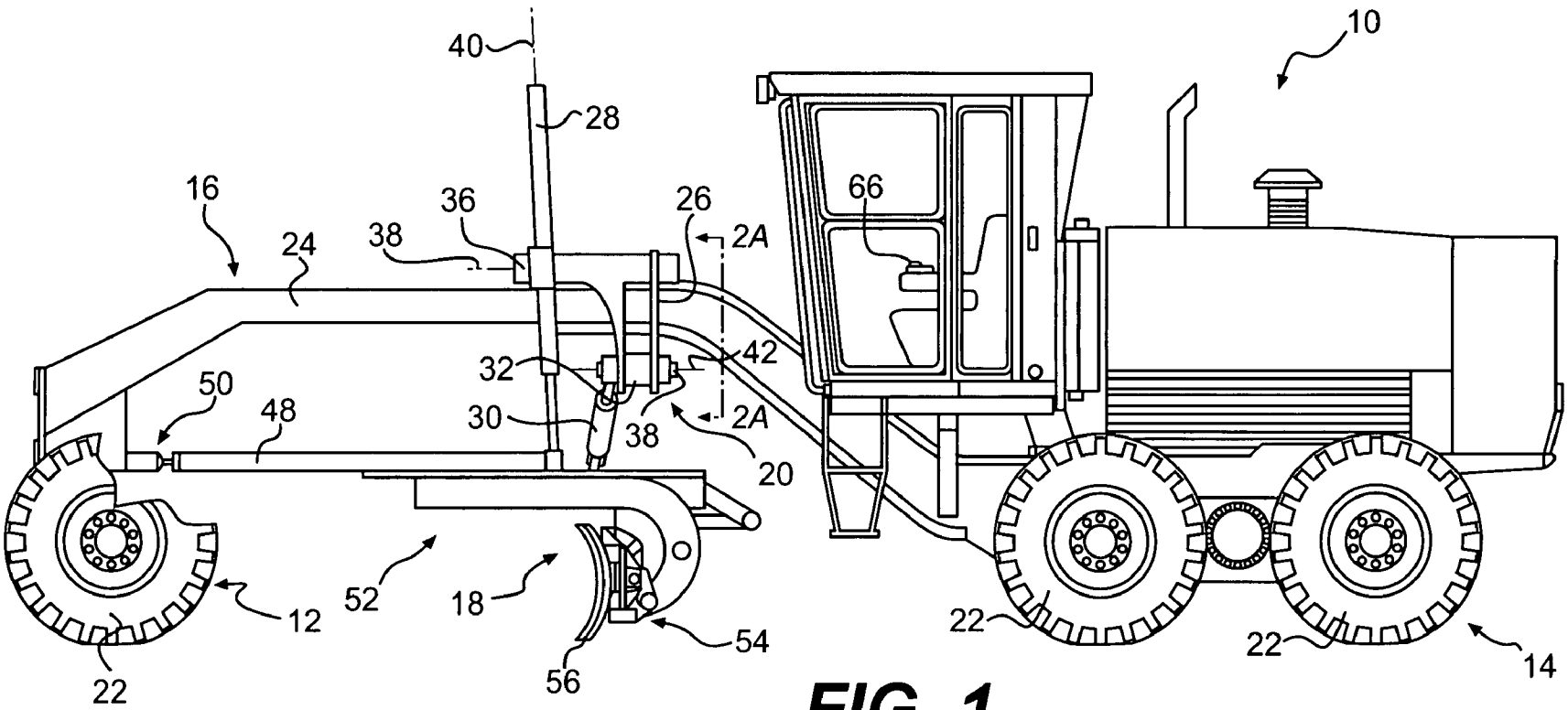
FIG. 1 is a diagrammatic illustration of an exemplary disclosed machine.

An exemplary embodiment of a machine 10 is illustrated in FIG. 1. Machine 10 may be a motor grader, a backhoe loader, an agricultural tractor, a wheel loader, a skid-steer loader, or any other type of machine known in the art. Machine 10 may include a steerable traction device 12, a driven traction device 14, and a frame 16 connecting steerable traction device 12 to driven traction device 14. Machine 10 may also include a work implement such as, for example, a drawbar-circle-moldboard assembly (DCM) 18, and a linkage positioning system 20.

Both steerable and driven traction devices 12, 14 may include one or more wheels 22 located on each side of machine 10 (only one side shown). Alternatively, steerable and/or driven traction devices 12, 14 may include tracks, belts, or other traction devices known in the art. Steerable traction devices 12 may or may not also be driven, while driven traction device 14 may or may not also be steerable. Frame 16 may connect steerable traction device 12 to driven traction device 14 by way of, for example, an articulated joint (not shown).

Frame 16 may include a beam member 24 that supports a fixedly connected center shift mounting member 26. Beam member 24 may be, for example, a single formed or assembled beam having a substantially hollow square cross-section. The substantially hollow square cross-section may provide frame 16 with a substantially high moment of inertia required to adequately support DCM 18 and center shift mounting member 26. The cross-section of beam member 24 may alternatively be rectangular, round, triangular, or any other appropriate shape.

Center shift mounting member 26 may support a pair of double acting hydraulic rams 28 (only one shown) for affecting vertical movement of DCM 18, a double acting hydraulic ram 30 for affecting horizontal movement of DCM 18, a link bar 32 adjustable between a plurality of predefined positions, and linkage positioning system 20. Center shift mounting member 26 may be welded or otherwise fixedly connected to beam member 24 and configured to indirectly support hydraulic rams 28 by way of a pair of bell cranks 36 (not shown) also known as lift arms. That is, bell cranks 36 may be pivotally connected to center shift mounting member 26 along a horizontal axis 38, while hydraulic rams 28 may be pivotally connected to bell cranks 36 along a vertical axis 40. Each bell crank 36 may further be pivotally connected to link bar 32 along a horizontal axis 42. Hydraulic ram 30 may be similarly pivotally connected to link bar 32.

Figure 2A:
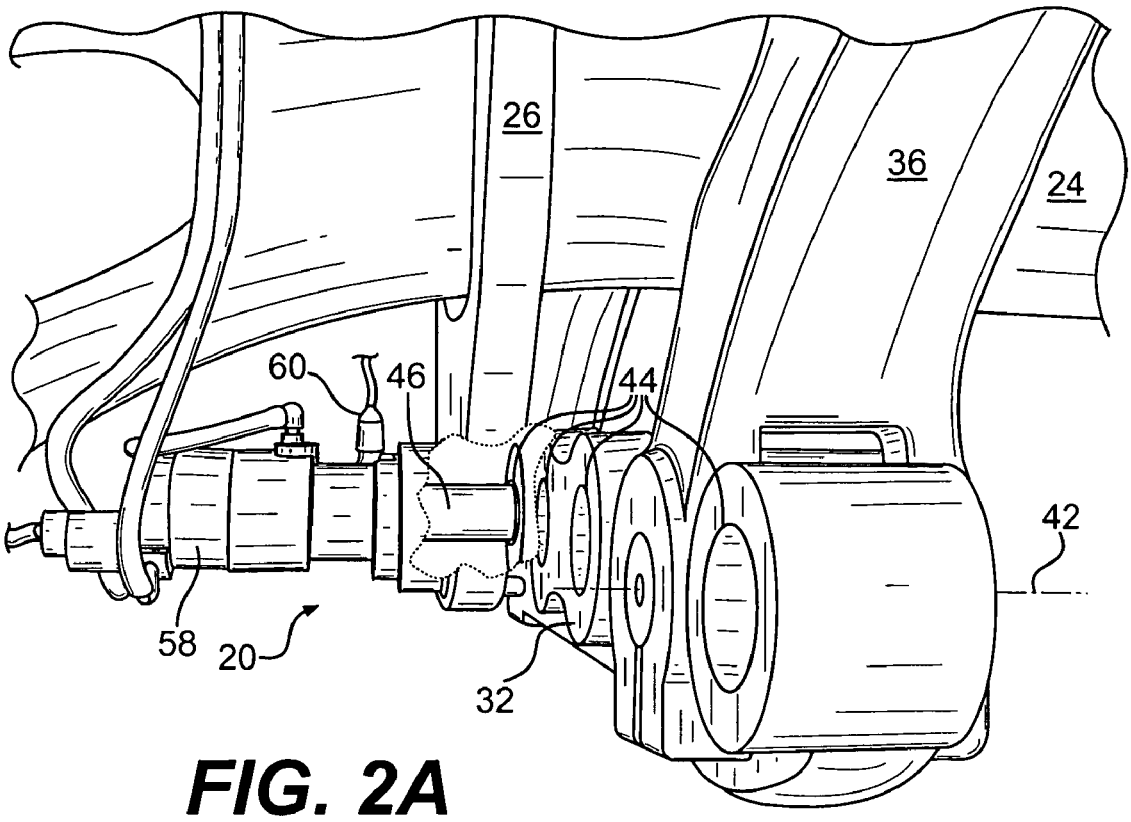
FIG. 2A is an oblique view illustration of an exemplary disclosed linkage positioning system for use with the machine of FIG. 1.

As illustrated in FIG. 2, center shift mounting member 26 may pivotally support link bar 32 by way of linkage positioning system 20. In particular, link bar 32 may include a plurality of through holes 44 configured to receive a lock pin 46 of positioning system 20. Depending on which of holes 44 receives lock pin 46, link bar 32 and connected hydraulic ram 30 may shift from left to right or visa versa, relative to beam member 24. In this manner, lock pin 46 may selectively engage any one of the holes 44 in link bar 32 to affect adjustment of DCM 18.

DCM 18 (referring to FIG. 1) may include a drawbar member 48 supported by beam member 24 and a ball and socket joint 50 located proximal steerable traction devices 12. As hydraulic rams 28 or 30 are actuated, DCM 18 may pivot about ball and socket joint 50. A circle assembly 52 may be connected to drawbar member 48 via a motor (not shown) to drivingly support a moldboard assembly 54 having a blade 56. In addition to DCM 18 being both vertically and horizontally positioned relative to beam member 24, DCM 18 may also be controlled to rotate circle and moldboard assemblies 52, 54 relative to drawbar member 48. Blade 56 may be positioned both horizontally and vertically, and oriented relative to circle assembly 52. It is contemplated that DCM 18 may be omitted, if desired, and replaced with a different work implement such as, for example, a ripper, a bucket, a snow plow, or another work implement known in the art.

Figure 2B:
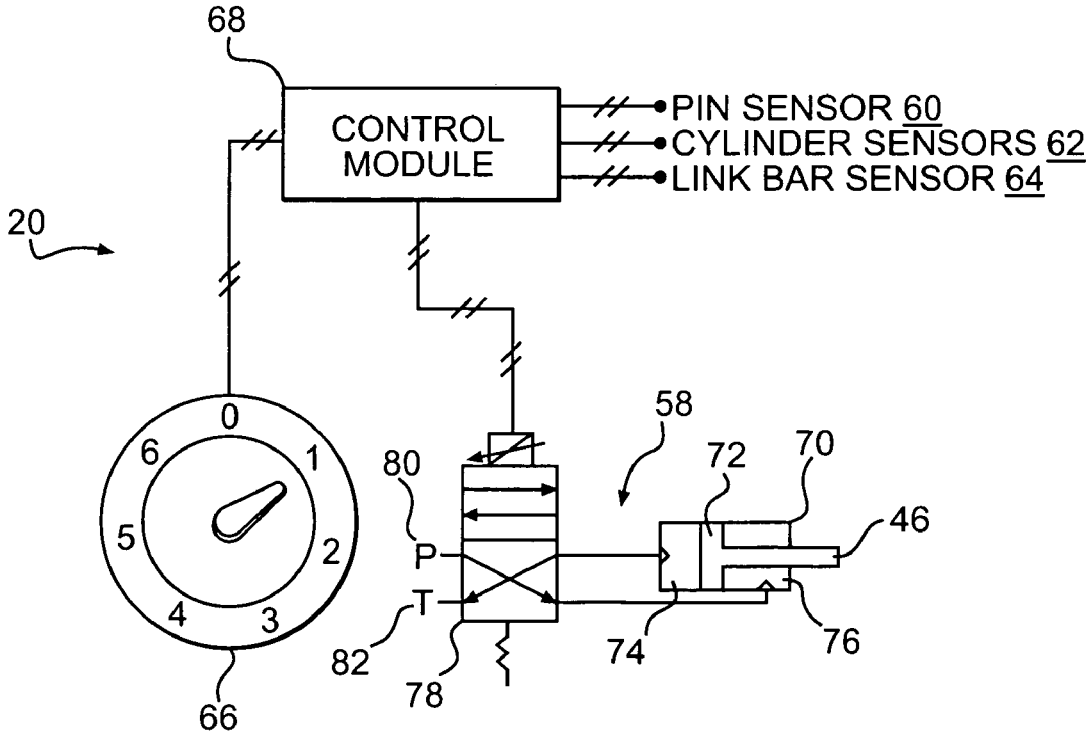
FIG. 2B is a schematic illustration of the linkage positioning system of FIG. 2A.

Linkage positioning system 20 may control the position of link bar 32. As illustrated in FIG. 2B, linkage positioning system 20 may include an actuator 58 configured to selectively retract and extend lock pin 46 relative to holes 44 (referring to FIG. 2A), a lock pin sensor 60, one or more cylinder position sensors 62 associated with hydraulic rams 28 and 30, a link bar sensor 64, an operator interface device 66, and a control module 68. In response to operator manipulation of interface device 66, control module 68 may cause actuator 58 to retract lock pin 46 from one of holes 44, cause hydraulic rams 28 and/or 30 to move link bar 32 and align a different one of holes 44 with lock pin 46, and cause actuator 58 to engage lock pin 46 with the newly aligned one of holes 44.

Actuator 58 may be provided to move lock pin 46. In one example actuator 58 may be a hydraulic type actuator having include a tube 70 and a piston assembly 72 arranged to form opposing pressure chambers 74, 76. Pressure chambers 74 and 76 may be selectively supplied with pressurized fluid and drained of the pressurized fluid to cause piston assembly 72 to displace within tube 70, thereby retracting or extending lock pin 46. It is contemplated that piston assembly 72 may or may not be integral with lock pin 46. The flow rate of fluid into and out of the pressure chambers may relate to a velocity of lock pin 46, while a pressure differential between the pressure chambers 74, 76 may relate to a force imparted by piston assembly 72 on lock pin 46. It is contemplated that the flow rate and/or the pressure of the fluid supplied to pressure chambers 74, 76 may be varied to selectively change the speed and or engagement force of lock pin 46, if desired. It is also contemplated that actuator 58 may alternatively embody a non-hydraulic actuator, if desired.

A valve element 78 may be associated with actuator 58 to control the filling and draining of pressure chambers 74, 76 described above. One embodiment of a valve element 78 is shown in FIG. 2B. Valve element 78 may be solenoid movable against a spring bias from a first position at which pressure chamber 74 is connected with a source of pressurized fluid 80 (designated as "P" in FIG. 2B) and pressure chamber 76 is connected with a low pressure reservoir 82 (designated as "T" in FIG. 2B), to a second position at which the connections between pressure chambers 74, source 80, and reservoir 82 are switched. Valve element 78 may receive from control module 68 a flow rate or valve element position command signal that initiates the movement of valve element 78 from the first position to the second position. It is contemplated that valve element 78 may be further movable to a third position at which substantially all fluid flow to and from pressure chambers 74 and 76 is blocked, if desired.

Source 80 may draw fluid from reservoir 82 and pressurize the fluid to a predetermined level. Specifically, source 80 may embody a pumping mechanism such as, for example, a variable displacement pump, a fixed displacement pump, or any other source known in the art. Source 80 may be drivably connected to a power source (not shown) of machine 10 by, for example, a countershaft (not shown), a belt (not shown), an electrical circuit (not shown), or in any other suitable manner. Alternatively, source 80 may be indirectly connected to the power source via a torque converter, a reduction gear box, or in any other suitable manner.

Reservoir 82 may constitute a tank configured to hold a supply of fluid. The fluid may include, for example, a dedicated hydraulic oil, an engine lubrication oil, a transmission lubrication oil, or any other fluid known in the art. One or more hydraulic systems within machine 10 may draw fluid from and return fluid to reservoir 82. It is contemplated that actuator 58 may be connected to multiple separate fluid tanks or to a single tank.

Lock pin sensor 60 may sense the location of lock pin 46. Specifically, lock pin sensor 60 may embody a magnetic pickup type sensor disposed within actuator 58 and associated with a magnet (not shown) embedded within lock pin 46. As lock pin sensor 60 moves from a fully extended position to a fully retracted position and visa versa, lock pin sensor 60 may provide to control module 68 an indication of the position of lock pin 46. It is contemplated that lock pin sensor 60 may alternatively embody another type of position sensor configured to directly or indirectly sense the position of lock pin 46.

Cylinder position sensors 62 may sense the extension and retraction of hydraulic rams 28 and/or 30. In particular, cylinder position sensors 62 may embody magnetic pickup type sensors associated with magnets (not shown) embedded within the piston assemblies of hydraulic rams 28 and 30. As hydraulic rams 28 and 30 extend and retract, cylinder position sensors 62 may provide to control module 68 an indication of the position of hydraulic rams 28 and/or 30. It is contemplated that cylinder position sensors 62 may alternatively embody other types of position sensors such as, for example, magnetostrictive-type sensors associated with a wave guide internal to hydraulic rams 28 and 30, cable type sensors associated with cables externally mounted to hydraulic rams 28 and 30, internally or externally mounted optical type sensors, or any other type of position sensor known in the art.

Link bar sensor 64 may sense the rotational angle of bell crank 36 about horizontal axis 38. For example, link bar sensor 64 may embody a magnetic pickup type sensor associated with a magnet (not shown) embedded within a protruding portion of center shift mounting member 26. As bell crank 36 rotates about horizontal axis 38, link bar sensor 64 may provide to control module 68 an indication of the angular position of bell crank 36. The angular position of bell crank 36 may be directly related to the alignment of lock pin 46 with a particular one of holes 44 in link bar 32. It is contemplated that link bar sensor 64 may alternatively embody another type of angular position sensor such as, for example, an optical type sensor.

Operator interface device 66 may be disposed within an operator station of machine 10 to receive input from a machine operator indicative of a desired engagement of lock pin 46 and holes 44 in link bar 32. Specifically, operator interface device 66 may embody a dial type device located proximal to an operator seat. An operator of machine 10 may move a lever portion of interface device 66 to produce an interface device position signal indicative of a desired lock pin/link bar engagement. It is contemplated that additional and/or different operator interface devices may be included within the operator station of machine 10 to perform this function such as, for example, wheels, knobs, push-pull devices, switches, pedals, interactive screen display systems, and other operator interface devices known in the art.

Control module 68 may embody a single microprocessor or multiple microprocessors that include a means for controlling the operation of linkage positioning system 20. Numerous commercially available microprocessors can be configured to perform the functions of control module 68. It should be appreciated that control module 68 could readily embody a general machine microprocessor capable of controlling numerous machine functions. Control module 68 may include a memory, a secondary storage device, a processor, and any other components for running an application. Various other circuits may be associated with control module 68 such as power supply circuitry, signal conditioning circuitry, solenoid driver circuitry, and other types of circuitry.

One or more maps relating interface device position, hydraulic ram position, lock pin position, link bar position, and command signals sent to valve element 78 of actuator 58 may be stored within the memory of control module 68. Each of these maps may be in the form of tables, graphs, and/or equations. For example, a hydraulic ram position and link bar position may form the coordinate axis of a 3-D map used for determining a location of a specific one of holes 44. That is, a specific position of hydraulic rams 28 and/or 30 and a specific angular position of bell crank 36 may correspond to an alignment of link pin 46 with a particular one of holes 44. In another example, a positional signal from operator interface device 66 may form the only coordinate axis in a 2-D map used to determine a commanded lock pin/hole engagement. In another example, a re-writable 1-D map may store the current location of lock pin 46. Control module 68 may be configured to reference these maps and control the operation of hydraulic rams 28 and 30, and actuator 58 in response to operator input received via operator interface device 66.

Figure 3:
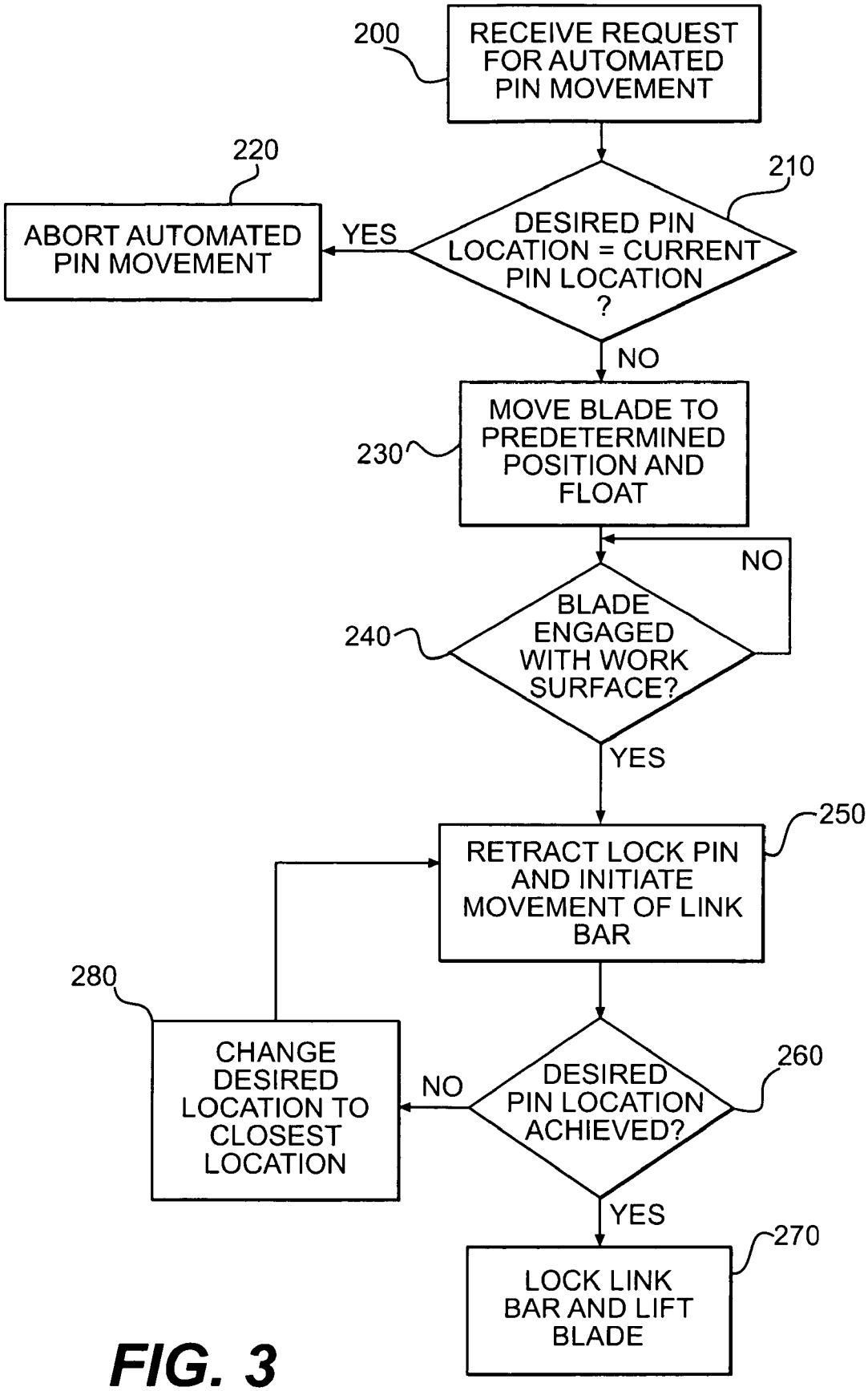
FIG. 3 is a flowchart illustrating an exemplary method of operating the linkage positioning system of FIGS. 2A and 2B.

FIG. 3 illustrates an exemplary method of operating linkage positioning system 20. FIG. 3 will be discussed in the following section to further illustrate the disclosed system and its operation.

INDUSTRIAL APPLICABILITY

The disclosed linkage positioning system may be applicable to any machine that includes an adjustable linkage member where simplicity, accuracy, minimal manual interaction, and reliability is desired. The disclosed linkage positioning system may improve the practice of adjusting the position of work tool-related linkage by implementing a fully automated process with a backup provision. The operation of linkage positioning system 20 will now be explained.

During operation of machine 10, a machine operator may manipulate operator interface device 66 to command a change in the position of link bar 32 that results in the transverse adjustment of DCM 18 relative to a work surface (Step 200). The actuation position of operator interface device 66 may be related to a particular operator commanded engagement of lock pin 46 with a particular one of holes 44 in link bar 32. Operator interface device 66 may generate a position signal indicative of this operator commanded engagement during operator manipulation and send this position signal to control module 68.

Control module 68 may receive the position signal from operator interface device 66 and respond accordingly (Step 210). In particular, control module 68 may compare the current location of lock pin 46 (e.g., the engagement of lock pin 46 with a particular one of holes 44 manifest through the sensed positions of hydraulic rams 28 and 30) to the location commanded via operator interface device 66. If the current location of lock pin 46 is the same as the commanded location, the automated movement of lock pin 46 to a new location may be aborted (Step 220).

However, if the current location of lock pin 46 is different from the commanded location, control module 68 may move DCM 18 to a predetermined location where blade 56 engages the work surface, and then allow blade 56 to float (e.g., allow the unrestricted flow of hydraulic fluid to and from hydraulic rams 28) (Step 230). The predetermined location may be stored within the map(s) of control module 68 or, alternatively, may be continuously learned and/or updated based on previous operations of machine 10. To move blade 56 to the predetermined location, control module 68 may selectively and automatically retract or extend hydraulic rams 28 and 30. It is contemplated that control module 68 may alternatively allow blade 56 to float into engagement with the work surface, if desired.

Control module 68 may sense the engagement of blade 56 with the work surface (Step 240), and reposition DCM 18 or begin realignment of holes 44 with lock pin 46 in response thereto. Specifically, if control module 68 senses the engagement of blade 56 with the work surface (e.g., if the sensed position of hydraulic rams 28 or 30 ceases to change or if the pressure of the fluid within hydraulic rams 28 or 30 sharply increases), control module 68 may signal actuator 58 to retract lock pin 46 from the current one of holes 44 and initiate movement of link bar 32 that aligns the commanded one of holes 44 with lock pin 46 (Step 250). Control module 68 may implement closed loop control of DCM movement until blade 56 has engaged the work surface. That is, control may not proceed to Step 250 until confirmation of DCM engagement with the work surface has been attained.

With lock pin 46 retracted from link bar 32, actuation of hydraulic ram 30 may result in the horizontal movement of link bar 32. Similarly, with lock pin 46 in the retracted position, actuation of hydraulic rams 28 may result in the vertical movement of link bar 32. By monitoring the signals from cylinder position sensors 62 and link bar sensor 64, and comparing the monitored signals with the relationship map(s)

stored within the memory of control module 68, control module 68 may determine when the commanded one of holes 44 is properly aligned with lock pin 46 (Step 260). Once the operator commanded one of holes 44 is aligned with lock pin 46, control module 68 may command actuator 58 to extend lock pin 46 into engagement with link bar 32, and raise DCM 18 such that blade 56 is removed from the work surface (Step 270). The raising of blade 56 from the work surface may signal to the operator of machine 10 that the automatic process of positioning lock pin 46 is complete. It is contemplated that other methods of notifying the operator of the completed process may alternatively be implemented, if desired.

However, if alignment of the commanded one of holes 44 with lock pin 46 has not been achieved, control module 68 may implement a backup procedure to ensure functionality of machine 10. That is, if linkage positioning system 20 has failed to complete the operator-commanded pin positioning, control module 68 may reset the commanded pin location to the nearest achievable pin location and return control to step 250 (Step 280). For example, when lock pin 46 is engaged with a far left one of holes 44 when viewed from a front end of machine 10, an operator may command engagement of lock pin 46 with the one of holes 44 that is three locations to the right (e.g., the fourth hole). After cycling through steps 200-250, control module 68 may determine that engagement of lock pin 46 with the fourth hole is not possible based on a time duration since initiation of the movement or, alternatively, based on the inability to actuate one or more of hydraulic actuators 28 and 30. Upon determining that the commanded engagement is impossible, control module 68 may then attempt to engage lock pin 46 with the one of holes 44 between the previously engaged hole and the commanded hole that is closest to the commanded hole (e.g., the one of holes 44 that is two locations to the right or the third hole). This process may be repeated until lock pin 46 successfully engages one of holes 44.

Because linkage positioning system 20 may be fully automated (e.g., all movement of hydraulic rams 28 and 30 and link pin 46 may be controlled by control module 68 during the linkage positioning process without operator intervention), the positioning of link bar 32 may be simple, accurate, efficient, and minimize the likelihood of damage to the associated machine. In particular, because the positioning of link bar 32 may require no or little involvement from the operator, other than to select a desired engagement of lock pin 46 with holes 44 in link bar 32, even a fairly inexperienced operator may be able to perform the operation. In addition, because the alignment of lock pin 46 and holes 44 may require no or minimal manual manipulation of hydraulic rams 28 and 30, the likelihood of achieving proper alignment is high. Further, in the situation where the requested positioning of link bar 32 is impossible, the backup provision of linkage positioning system 20 may ensure continued operation of the associated machine. Also, because positioning system 20 may provide an indication that the positioning process has completed successfully, the likelihood of an operator resuming manual control of machine 10 without full engagement of lock pin 46 with holes 44 may be low.

It will be apparent to those skilled in the art that various modifications and variations can be made to the disclosed linkage positioning system. Other embodiments will be apparent to those skilled in the art from consideration of the specification and practice of the disclosed linkage positioning system. It is intended that the specification and examples be considered as exemplary only, with a true scope being indicated by the following claims and their equivalents.

What is claimed is:

1. A linkage positioning system, comprising:

a lock pin;

a linkage member having a plurality of holes configured to receive the lock pin;

an actuator configured to selectively extend and retract the lock pin; and a control module in communication with the actuator, the control module including a memory having at least one map stored in the memory, the at least one map including information relating to a position of one or more elements of the positioning system, the control module being configured to:

receive a request for lock pin engagement with the linkage member; and based in part on the at least one map, control the actuator to:

retract the lock pin from a first of the plurality of holes in the linkage member;

move the linkage member to align a second of the plurality of holes with the lock pin; and extend the lock pin into the second of the plurality of holes;

wherein the control module is further configured to implement a backup positioning procedure in the event of failure to achieve the operator requested lock pin engagement, the backup positioning procedure including extending the lock pin into the one of the plurality of holes that is nearest the one of the plurality of holes associated with the operator requested lock pin engagement.

2. The linkage positioning system of claim 1, wherein the linkage positioning system is associated with a work tool and the control module is further configured to engage the work tool with a work surface prior to retracting the lock pin.

3. The linkage positioning system of claim 2, wherein the control module is further configured to float the work tool prior to retracting the lock pin.

4. The linkage positioning system of claim 2, wherein the control module is further configured to raise the work tool from the surface upon successful extension of the lock pin into the second of the plurality of holes.

5. The linkage system of claim 1, further including:

a hydraulic actuator associated with the linkage member; and at least one sensor associated with the hydraulic actuator, wherein the control module is configured to receive from the at least one sensor an indication of the alignment of the plurality of holes with the lock pin.

6. The linkage positioning system of claim 5, wherein the at least one sensor is configured to sense an angle of the hydraulic actuator relative to a mounting member.

7. The linkage positioning system of claim 5, wherein the at least one sensor is configured to sense an extension of the hydraulic actuator.

8. The linkage positioning system of claim 1, wherein the at least one map includes information relating to one or more of an interface device position, a hydraulic ram position, a lock pin position, and a link bar position.

9. A method of positioning a linkage of a machine, the method comprising:

receiving a request for engagement of a lock pin with a linkage member; and in response to the request, controlling movement of the lock pin relative to the linkage member based on stored information relating to a position of one or more elements of the machine, the information being stored in the form of at least one map, wherein controlling movement includes:

automatically retracting the lock pin from a first of a plurality of holes in the linkage member;

automatically moving the linkage member to align a second of the plurality of holes with the lock pin;

automatically extending the lock pin into the second of the plurality of holes; and determining whether achievement of the requested engagement is impossible and, if engagement is impossible, implementing a backup positioning procedure that includes extending the lock pin into the one of the plurality of holes that is nearest the one of the plurality of holes associated with the operator requested lock pin engagement.

10. The method of claim 9, further including engaging a work tool operatively connected to the linkage member with a work surface prior to retracting the lock pin.

11. The method of claim 10, further including floating the work tool prior to retracting the lock pin.

12. The method of claim 10, further including raising the work tool from the work surface upon successful extension of the lock pin into the second of the plurality of holes.

13. The method of claim 9, further including sensing a position of a hydraulic ram associated with the linkage member to determine alignment of the plurality of holes with the lock pin.

14. The method of claim 9, further comprising sensing at least one signal indicative of one or more of a lock pin position, a position of a hydraulic ram associated with the linkage member, or a link bar position; and controlling movement of the lock pin relative to the linkage member based on the at least one sensed signal.

15. A machine, comprising:

a steerable traction device;

a driven traction device;

a frame operatively connecting the driven traction device to the steerable traction device and having a mounting member;

a drawbar-circle-moldboard assembly;

a link bar having a plurality of holes;

at least one hydraulic ram operatively connecting the drawbar-circle-moldboard assembly to the link bar; and a positioning system operatively connecting the link bar to the mounting member, the positioning system including:

a lock pin configured for extension into and retraction from the plurality of holes in the link bar;

an actuator configured to selectively extend and retract the lock pin; and a control module in communication with the actuator, the control module including a memory with at least one map stored in the memory, the at least one map including information relating to a position of one or more of the lock pin, the link bar, the drawbar-circle-moldboard assembly, the mounting member, and the at least one hydraulic ram, the control module configured to:

receive a request for lock pin engagement with the linkage member; and based in part on the at least one map, control the actuator to:

engage the drawbar-circle-moldboard assembly with a work surface;

retract the lock pin from a first of the plurality of holes in the linkage member;

move the linkage member to align a second of the plurality of holes with the lock pin;

extend the lock pin into the second of the plurality of holes; and raise the drawbar-circle-moldboard assembly from the work surface upon successful extension of the lock pin into the second of the plurality of holes;

wherein the control module is further configured to extend the lock pin into the one of the plurality of holes that is nearest the one of the plurality of holes associated with the operator requested lock pin engagement when the control module has failed to achieve the operator requested lock pin engagement.

16. The machine of claim 15, wherein the control module is further configured to float the work tool prior to retracting the lock pin.

17. The machine of claim 15, further including at least one sensor associated with the at least one hydraulic ram, wherein the control module is configured to receive from the at least one sensor an indication of the alignment of the plurality of holes with the lock pin.

18. A linkage positioning system, comprising:

a lock pin;

a linkage member having a plurality of holes configured to receive the lock pin;

an actuator configured to selectively extend and retract the lock pin; and a control module in communication with the actuator, the control module being configured to:

receive a request for lock pin engagement with the linkage member;

retract the lock pin from a first of the plurality of holes in the linkage member;

move the linkage member to align a second of the plurality of holes with the lock pin;

extend the lock pin into the second of the plurality of holes; and implement a backup positioning procedure in the event of failure to achieve the operator requested lock pin engagement, wherein the backup positioning procedure includes extending the lock pin into the one of the plurality of holes that is nearest the one of the plurality of holes associated with the operator requested lock pin engagement.

19. A machine, comprising:

a steerable traction device;

a driven traction device;

a frame operatively connecting the driven traction device to the steerable traction device and having a mounting member;

a drawbar-circle-moldboard assembly;

a link bar having a plurality of holes;

at least one hydraulic ram operatively connecting the drawbar-circle-moldboard assembly to the link bar; and a positioning system operatively connecting the link bar to the mounting member, the positioning system including:

a lock pin configured for extension into and retraction from the plurality of holes in the link bar;

an actuator configured to selectively extend and retract the lock pin; and a control module in communication with the actuator, the control module configured to:

receive a request for lock pin engagement with the linkage member;

engage the drawbar-circle-moldboard assembly with a work surface;

retract the lock pin from a first of the plurality of holes in the linkage member;

move the linkage member to align a second of the plurality of holes with the lock pin;

extend the lock pin into the second of the plurality of holes; and raise the drawbar-circle-moldboard assembly from the work surface upon successful extension of the lock pin into the second of the plurality of holes; and when the control module has failed to achieve the operator requested lock pin engagement, extend the lock pin into the one of the plurality of holes that is nearest the one of the plurality of holes associated with the operator requested lock pin engagement.

* * * * *